US006972275B2

(12) United States Patent
Forbus, Jr.

(10) Patent No.: US 6,972,275 B2
(45) Date of Patent: Dec. 6, 2005

(54) OIL-IN-OIL EMULSION LUBRICANTS FOR ENHANCED LUBRICATION

(75) Inventor: Thomas R. Forbus, Jr., New Town, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 250 days.

(21) Appl. No.: 10/186,034

(22) Filed: Jun. 28, 2002

(65) Prior Publication Data

US 2004/0002429 A1 Jan. 1, 2004

(51) Int. Cl.[7] ..... C10M 105/02; C10M 105/18; C10M 105/32

(52) U.S. Cl. ..... 508/496; 508/579; 508/583; 508/591; 585/1

(58) Field of Search ..... 508/579, 591, 508/496; 585/1

(56) References Cited

U.S. PATENT DOCUMENTS

| | | | | | |
|---|---|---|---|---|---|
| 2,213,943 | A | | 9/1940 | Auer | 252/48 |
| 3,318,813 | A | | 5/1967 | McCormick et al. | 252/59 |
| 3,920,562 | A | | 11/1975 | Foehr | 252/32.7 |
| 4,089,790 | A | | 5/1978 | Adams | 252/18 |
| 4,101,429 | A | | 7/1978 | Birke | 252/32.7 |
| 4,149,984 | A | | 4/1979 | Wenzel et al. | 252/51.5 |
| 4,162,985 | A | | 7/1979 | Holubec | 252/32.7 |
| 4,163,729 | A | | 8/1979 | Adams | 252/18 |
| 4,183,821 | A | * | 1/1980 | Langdon et al. | 516/191 |
| 4,229,311 | A | | 10/1980 | Wenzel et al. | 252/50 |
| 4,282,132 | A | | 8/1981 | Benda et al. | 260/30.2 |
| 4,290,925 | A | | 9/1981 | Pennewiss et al. | 252/56 |
| 4,341,684 | A | * | 7/1982 | Krantz | 523/175 |
| 4,481,123 | A | | 11/1984 | Hentschel et al. | 252/52 |
| 4,568,775 | A | | 2/1986 | Aoshima et al. | 568/617 |
| 4,569,774 | A | | 2/1986 | Forbus | 252/33 |
| 4,594,378 | A | | 6/1986 | Tipton et al. | 524/106 |
| 4,611,031 | A | | 9/1986 | Galluccio et al. | 525/310 |
| 4,762,635 | A | | 8/1988 | Forbus | 252/73 |
| 4,954,275 | A | | 9/1990 | Rosenberger et al. | 252/48.6 |
| 4,988,797 | A | | 1/1991 | Wardle et al. | 528/408 |
| 5,180,856 | A | | 1/1993 | Stehr et al. | 568/617 |
| 5,268,115 | A | | 12/1993 | Gutierrez et al. | 252/51.5 |
| 5,465,810 | A | | 11/1995 | Peterson et al. | 184/6.21 |
| 5,484,866 | A | | 1/1996 | Loveless et al. | 526/340 |
| 5,485,895 | A | | 1/1996 | Peterson et al. | 184/6.22 |
| 5,599,100 | A | | 2/1997 | Jackson et al. | 366/152.5 |
| 5,602,085 | A | | 2/1997 | Peterson et al. | 508/579 |
| 5,602,086 | A | | 2/1997 | Le et al. | 508/591 |
| 6,087,307 | A | * | 7/2000 | Kaminski et al. | 508/223 |
| 6,455,711 | B1 | * | 9/2002 | Eller et al. | 549/472 |

FOREIGN PATENT DOCUMENTS

| | | | |
|---|---|---|---|
| WO | 00/29522 | 5/2000 | C10M/145/26 |

OTHER PUBLICATIONS

Smalheer et al, "Lubricant Additives", Section I–Chemistry of Additives, pp. 1–11, 1967.*

* cited by examiner

*Primary Examiner*—Ellen McAvoy
(74) *Attorney, Agent, or Firm*—Mark D. Marin

(57) ABSTRACT

Novel oil-in-oil emulsions and methods of lubrication using the same are provided. The lubricants are stable emulsions of carrier fluid and high viscosity fluid that display superior properties related to lubricating film thickness and reduced shear strength.

45 Claims, 3 Drawing Sheets

LP-Temperature Comparisons
of PAO-AN Blends w/ PTE Fluids

LP-Dynamic Viscosity Comparisons
of PAO-AN Blends w/ PTE Fluids

OIL-IN-OIL EMULSION LUBRICANTS FOR ENHANCED LUBRICATION

FIELD OF THE INVENTION

The present invention is related to novel lubricants characterized as stable liquid emulsions or liquid-in-liquid dispersions and methods of lubrication using the same. In particular, the invention is related to lubricant emulsions that are comprised of a low viscosity carrier fluid and a relatively small amount of a higher viscosity fluid, the combination imparting superior lubrication properties to the composition such as low viscosity and thick lubricating films.

BACKGROUND OF THE INVENTION

Lubrication results from the formation of a film of lubricant that is entrained into movable contacting surfaces of a mechanical assembly. The film separates the surfaces, thereby reducing friction and mechanical wear. Thicker films generally impart greater surface protection. Certain properties of lubricants are associated with lubrication performance and film thickness. In the case of liquid lubricants, viscosity of the fluid is directly correlated with the magnitude of the film (or film thickness) that builds and separates moving surfaces under contact, the greater viscosities contributing to greater film thickness.

A common lubrication condition involves elastically deformed surfaces in concentrated contact called elastohydrodynamic lubrication (EHL). According to EHL, the variation of viscosity with pressure (expressed as the pressure-viscosity coefficient) contributes to lubricant film thickness. For instance, liquid lubricants of identical viscosity at an arbitrary operating temperature may differ in film thickness. The lubricant with a higher pressure-viscosity coefficient provides greater film thickness. However, lubricants with high pressure-viscosity coefficients typically show greater variation of viscosity with temperature. The variation of viscosity with temperature is generally expressed as viscosity index (VI), and lubricants showing greater variation (reduced film thickness at higher temperatures) are characterized as having lower VI. Thus, the lower VI counterbalances any benefit derived from a high pressure-viscosity coefficient at higher temperatures. Only few liquids, such as those disclosed in U.S. Pat. No. 4,762,635, have pressure-viscosity coefficients able to compensate for a lower VI at typical operating temperatures.

Unfortunately, many lubricants that produce desirably thick films also have relatively high viscosities. High viscosity lubricants often contribute to problems such as poor flow properties, increased operating temperatures, and decreased operating efficiency of the lubricated device. Thus, lubricants with lower viscosities and thicker films are currently being developed for their desirable properties. For instance, U.S. Pat. No. 4,549,774 describes lithium salt-containing polyether and polyglycol fluids that show enhanced EHL film thickness (with respect to both temperature and pressure) and no corresponding increase in fluid kinematic viscosity.

Other lubricating difficulties involve the need for multiple lubricating properties for a single lubricated device. For instance, mechanical assemblies operating at a range of temperatures or having components that require different lubricating conditions have need for versatile lubricants that provide surface protection under a wide range of conditions. Multi-phase lubricants have been developed which employ a unique phase change to meet a variety of lubricating requirements. For instance, U.S. Pat. Nos. 5,602,085; 5,599,100; 5,485,895; and 5,465,810 reveal multi-phase lubricants having partially to substantially miscible components suitable for use in complex systems requiring a single lubricant. The lubricants disclosed therein depend on the formation of a single phase mixture of the components at elevated temperature or pressure such that lubricating properties unique from those of the separate components can be achieved.

As is evident, versatile lubricants that allow both maximum protection of contacting surfaces and maximum operating efficiency are desirable for a wide range of lubrication applications. In particular, liquid lubricants that have increased film thickness yet retain desirably low viscosities would promote greater operating efficiency and cost effectiveness of lubricated mechanical devices operating under elastohydrodynamic lubricating conditions. The present invention disclosed herein is directed toward improved lubricants which show such desirable properties as low viscosity and thick lubricating films.

SUMMARY OF THE INVENTION

The present invention encompasses novel lubricant compositions comprising at least two components, a carrier fluid and a minor amount of higher viscosity fluid, which are substantially immiscible. Together the two fluids form a stable emulsion capable of producing a lubricating film thickness greater than the expected film thickness.

Specifically, preferred lubricant compositions of the present invention comprise a low viscosity, carrier fluid and a minor amount of an immiscible or semi-miscible higher viscosity fluid. More specifically, preferred lubricant compositions of the present invention comprise a relatively non-polar, hydrocarbon carrier fluid and a minor amount of an immiscible or semi-miscible polar, hydrocarbon fluid. More specifically, preferred lubricant compositions of the present invention comprise a hydrocarbon carrier fluid and from about 0.01% to about 10% by weight of a higher viscosity poly-THF ester fluid.

The carrier fluid preferably comprises a blend of low viscosity PAO or a blend of low viscosity PAO with an alkylated aromatic fluid such as an alkylated naphthalene fluid.

In further aspects of the present invention, a method of lubrication is contemplated which includes applying a lubricant to a mechanical assembly having movable contacting surfaces wherein the lubricant comprises a stable emulsion of (1) a carrier fluid and (2) a higher viscosity fluid which together produce a film thickness greater than the expected film thickness.

In further aspects of the present invention, a method of lubrication is encompassed which includes the steps of providing a lubricant comprising a) hydrocarbon carrier fluid and b) poly-THF ester, and applying the lubricant to a mechanical assembly having movable contacting surfaces operating under elastohydrodynamic lubricating conditions. The carrier fluid preferably contains a blend of a low viscosity PAO and alkylated naphthalenes. The poly-THF ester fluid may be present in the lubricant in an amount of from about 0.01% to about 10% by weight.

In yet anther aspect of the present invention, lubricant compositions are encompassed that are prepared by a method comprising the steps of:

(a) combining carrier fluid and higher viscosity fluid to form a mixture, wherein the fluids are substantially immiscible;

(b) heating the mixture with agitation to a temperature at which the fluids dissolve to form a solution; and (c) cooling the solution to a temperature at which the fluids separate into a continuous phase and a discontinuous phase to yield an emulsion.

DESCRIPTION OF PREFERRED EMBODIMENTS

Figure 1:
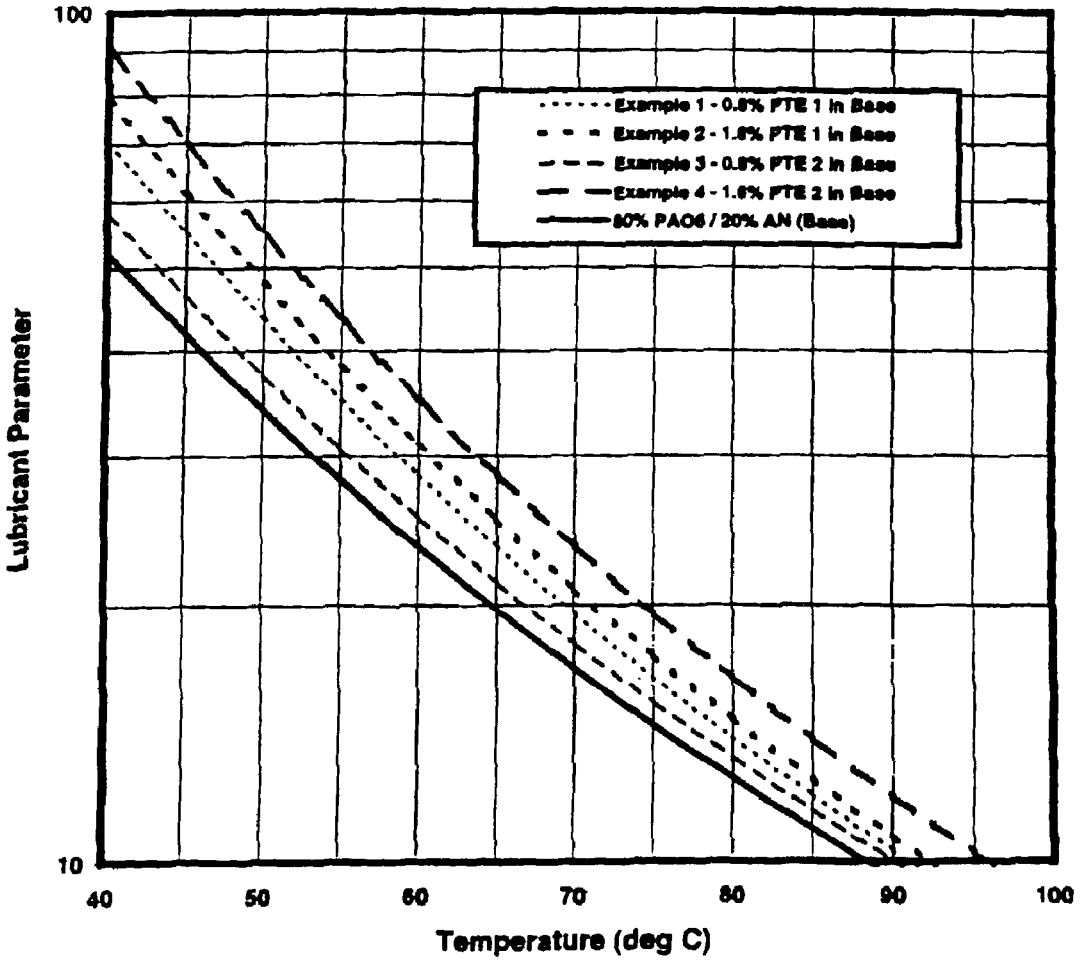
FIG. 1 displays comparative data for compositions of the present invention showing enhanced film thickness, expressed as LP, as a function of temperature.

As used herein, numerical ranges preceded by the term "about" should not be considered to be limited to the recited range. Rather, numerical ranges preceded by the term "about" should be understood to include a range accepted by those skilled in the art for any given element in a composition according to the present invention.

The term "higher viscosity fluid" and "high viscosity fluid" are used interchangeably herein and refer to fluids that have a viscosity higher than the viscosity of the carrier fluid.

The terms "lubricating film thickness," "EHL film thickness," and "film thickness" are used interchangeably herein and are meant to refer to the actual magnitude of the layer of lubricant residing on a lubricated surface in a mechanical assembly operating under the lubricating conditions.

The term "expected film thickness," as used herein, refers to a theoretical or calculated film thickness based on the expected contribution of the two fluid components. For example, the expected film thickness may be calculated from the dynamic viscosity of the mixture. In view of the minor amount of the higher viscosity fluid in the mixture the expected film thickness may also be calculated from the dynamic viscosity or the dynamic viscosity and pressure-viscosity coefficient of the carrier fluid alone. Thus, the expected film thickness represents a film thickness based on the viscosity of at least the carrier fluid.

Furthermore, the term "substantially immiscible," refers to fluids that tend to remain as separate phases when in contact with each other and do not readily form a single phase solution, even under mixing conditions such as elevated temperature and agitation.

As used herein, the term "stable emulsion" denotes a liquid composition having a continuous hydrocarbon, liquid phase and a discontinuous, hydrocarbon, liquid phase with the discontinuous phase remaining substantially evenly dispersed throughout the continuous phase for an extended time period, including reasonable storage and usage times.

Preferred embodiments of the present invention can be characterized as novel liquid lubricants having at least two distinct liquid phases combined together as a stable emulsion. The components of the lubricant emulsion include a continuous phase of carrier fluid and a discontinuous phase of a fluid having a viscosity higher than the carrier fluid. These novel lubricants may be useful in many applications and are desirable for their superior properties related to low viscosities, improved film thickness, and better lubricating performance.

The lubricants of the present invention comprise a carrier fluid. This fluid can be any mixture of hydrocarbons, but is more suitably a composition of hydrocarbons useful in lubrication applications. For instance, crude oil products including mineral oils, lube oils, lube oil distillates, solvent refined oils, hydrotreated oils, deasphalted oils, dewaxed oils, hydrocracked oils, oils derived from Fischer-Tropsch products, and the like may be used as the carrier fluid. In addition, lubricant base oils, synthetic oils, and blends thereof may also be used, including for example, polyalphaolefins (PAO), alkylated aromatic fluids, and mixtures thereof.

Carrier fluids comprising blends of polyalphaolefins and alkylated aromatics are particularly suitable for the present invention. The polyalphaolefins may be derived from alphaolefins which include, but are not limited to, from $C_2$ to about $C_{32}$ alphaolefins. A preferred PAO is PAO6 which is characterized as a polyalphaolefin fluid having a kinematic viscosity of about 6 cSt at 100° C. Polyalphaolefins are well known to those skilled in the art and are well described in the literature, such as, for example, U.S. Pat. No. 4,041,098, herein incorporated by reference. A preferred alkylated aromatic may be alkylated naphthalene (AN). Specifically, PAO-based carrier fluids, containing from about 5% to about 95% by weight PAO and from about 5% to about 95% by weight alkylated aromatics, or more preferably from about 50% to about 90% by weight PAO and from about 10% to about 50% by weight alkylated aromatic, or even more preferably about 75% to about 85% by weight PAO and about 15% to about 25% by weight alkylated aromatic, are encompassed by the present invention. Other suitable PAO/alkylated aromatic blends include those disclosed in U.S. Pat. No. 5,602,086, incorporated herein by reference in its entirety.

The lubricants of the present invention also contain proportionally smaller amounts of a high viscosity fluid which contribute to lubrication performance. The high viscosity fluid may be characterized as having greater viscosity than the carrier fluid. Preferred viscosities range from about 10 to about 10,000 cSt at 100° C. The high viscosity fluid is also preferably substantially immiscible with the carrier fluid over the range of temperatures likely to be encountered under storage and lubricating conditions so as to maintain a two-phase system throughout its use.

Suitable high viscosity fluids may include any type of viscous liquid. Preferable high viscosity fluids include, but are not limited to, polyethers and derivatives thereof. Polyethers may include any polymer or oligomer containing a plurality of ether moieties including, for example, polyalkylene glycols, such as polypropylene glycol and polyethylene glycol, and their corresponding monoethers, diethers, monoesters, and diesters. Also contemplated by the present invention are polyethers derived from the polymerization of cyclic ethers such as epoxides and oxiranes, including tetrahydrofuran. Examples of polymerized cyclic ethers suitable as high viscosity fluids are disclosed in U.S. Pat. Nos. 4,481,123; 4,568,775; 4,988,797; 5,180,856; and U.S. Ser. No. 09/192,966, incorporated herein by reference in their entireties.

A particularly suitable high viscosity fluid may be polytetrahydrofuran (p-THF) ester fluids. These fluids can be made by the condensation reaction between p-THF and dibasic carboxylic acids to yield crosslinked p-THF products which are further reacted with monobasic carboxylic acids to endcap the terminal hydroxyl groups in a second condensation reaction. The resulting p-THF ester fluid may be described as a mixture of polymers comprising one or more each of the structural polymeric components depicted in formulas Ia, Ib, and Ic below. Formula Ia displays the repeating THF unit and Formula Ib displays the end-capped p-THF units of the ester fluid wherein $R^1$ is hydrogen or any substituted or unsubstituted $C_1$ to $C_{30}$ alkyl, aryl, or aralkyl group, including but not limited to methyl, ethyl, n-proply, isopropyl, n-butyl, t-butyl, phenyl, and benzyl. In addition, formula Ic depicts the p-THF linking dicarboxylic acid repeating units of the ester fluid wherein $R^2$ and $R^3$ are, independently, hydrogen or any substituted or unsubstituted $C_1$ to $C_{30}$ alkyl, aryl, alkoxy, aryloxy, or aralkyl group. Variables m and p can be, independently, any integer of 1 or more. Other repeating units derived from, such as for example, substituted or unsubstituted ethylene glycols, propylene glycols, and cyclic ethers, may also be incorporated into the p-THF ester fluids. Further, the p-THF ester fluids may be characterized as having viscosities ranging from about 150 to about 10,000 cSt at 100° C.

Ia

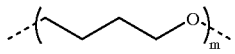

Ib

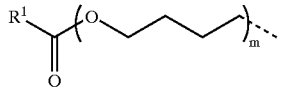

Ic

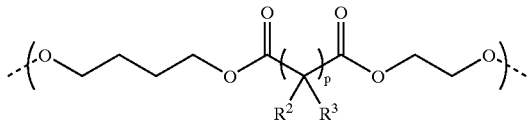

In preferred embodiments of the present invention, the higher viscosity fluid is dispersed in the carrier fluid such that a stable emulsion or liquid-in-liquid dispersion is formed. The carrier fluid constitutes the continuous phase while the higher viscosity fluid constitutes the discontinuous phase of the stable emulsion. The higher viscosity fluid preferably remains evenly dispersed throughout the carrier for relatively long periods of time such that the emulsion is stable for its duration of use and reasonable storage time. Preferred lubricants of the present invention are characterized by small droplets of the high viscosity fluid dispersed in the carrier fluid. Ideally, the droplets are of a size sufficient to prevent rapid coalescence, thus contributing to emulsion stability. The mean number average droplet size (as determined for example by laser light scattering experiments) may range from about 0.01 microns to about 10 microns, or more preferably from about 0.1 microns to about 5 microns, or even more preferably, may be about 1 micron.

The higher viscosity fluid is preferably present in the lubricant in an amount sufficient to promote improved lubrication performance relative to the carrier fluid. In addition, a sufficient amount of higher viscosity fluid is desirable to promote the formation of a two-phase lubricant. As such, an amount of fluid may be required such that it surpasses the critical miscibility concentration. Generally, the higher viscosity fluid will be present in the carrier fluid in relatively small amounts. Typically, the amount of higher viscosity fluid in the lubricant ranges from about 0.1% to about 10% by weight, or more preferably from about 0.1% to about 10% by weight, or even more preferably from about 0.1% to about 3% by weight. Further, the higher viscosity fluids of the present invention may comprise p-THF ester fluids in any amount. Preferably, the presently described lubricant emulsions comprise ester fluids in amounts ranging from about 0.01% to about 10% by weight, or more preferably from about 0.01% to about 3% by weight, or even more preferably from about 0.01% to about 1.6% by weight.

In some embodiments, the lubricant comprises about 98.4% 4:1 PAO6/AN mixture by weight and about 1.6% by weight p-THF ester fluid.

The lubricants of the present invention may also contain additives that impart certain desirable properties to the compositions. The additives contemplated for use herein can be, for example, emulsifiers, rust and corrosion inhibitors, metal passivators, dispersants, antioxidants, thermal stabilizers, EP/antiwear agents and the like. These additives materials do not detract from the value of the compositions of this invention, rather they serve to impart their customary properties to the particular compositions in which they are incorporated.

In general, the lubricant emulsions of the present invention can be prepared by any method known in the art for making stable emulsions. More specifically, the lubricants described herein can be prepared by heating the carrier and the high viscosity fluid together to a temperature where they dissolve with agitation followed by cooling the mixture. A protocol for producing lubricants of the present invention may include the steps of combining carrier fluid and higher viscosity fluid, heating the resulting mixture with simultaneous agitation to a temperature at which the fluids substantially dissolve, and cooling the dissolved fluids to a temperature at which the fluids separate into a continuous phase and a discontinuous phase so that an emulsion is formed.

Some of the most important and intriguing aspects of the presently described lubricants include their unexpectedly superior lubricating performance. Generally, better lubricants form thicker films on the surfaces they coat. However, greater film thickness is a characteristic of fluids having high viscosity, itself an undesirable property that contributes to lower operating efficiencies. The lubricants described herein counter this film thickness/viscosity trend by showing unusually greater film thickness for their measured viscosities. This unusual property has been observed in a point contact optical EHL film thickness measurement device in which EHL film thickness is measured as a function of temperature and dynamic viscosity (product of kinematic viscosity and density). EHL film thickness can be expressed as LP, the lubricant parameter, which is a product of the dynamic viscosity, $\eta_0$ (cP), and the pressure-viscosity coefficient, $\alpha$ ($psi^{-1}$), according to equation 1:

$$LP=10^{11}\eta_0\alpha \quad \text{(Eq. 1)}$$

As apparent from equation 1, film thickness is expected to increase upon increasing the values for dynamic viscosity or pressure-viscosity coefficient, both values which are readily determined by one skilled in the art. LP is the lubricant contribution to film thickness in EHL contacts. The lubricant parameter (LP) concept is fully described in the industry publication *Mobil EHL Guidebook*, Fourth edition, Mobil Oil Corp., Technical Publications, Fairfax, Va., 1992, herein incorporated by reference.

Figure 2:
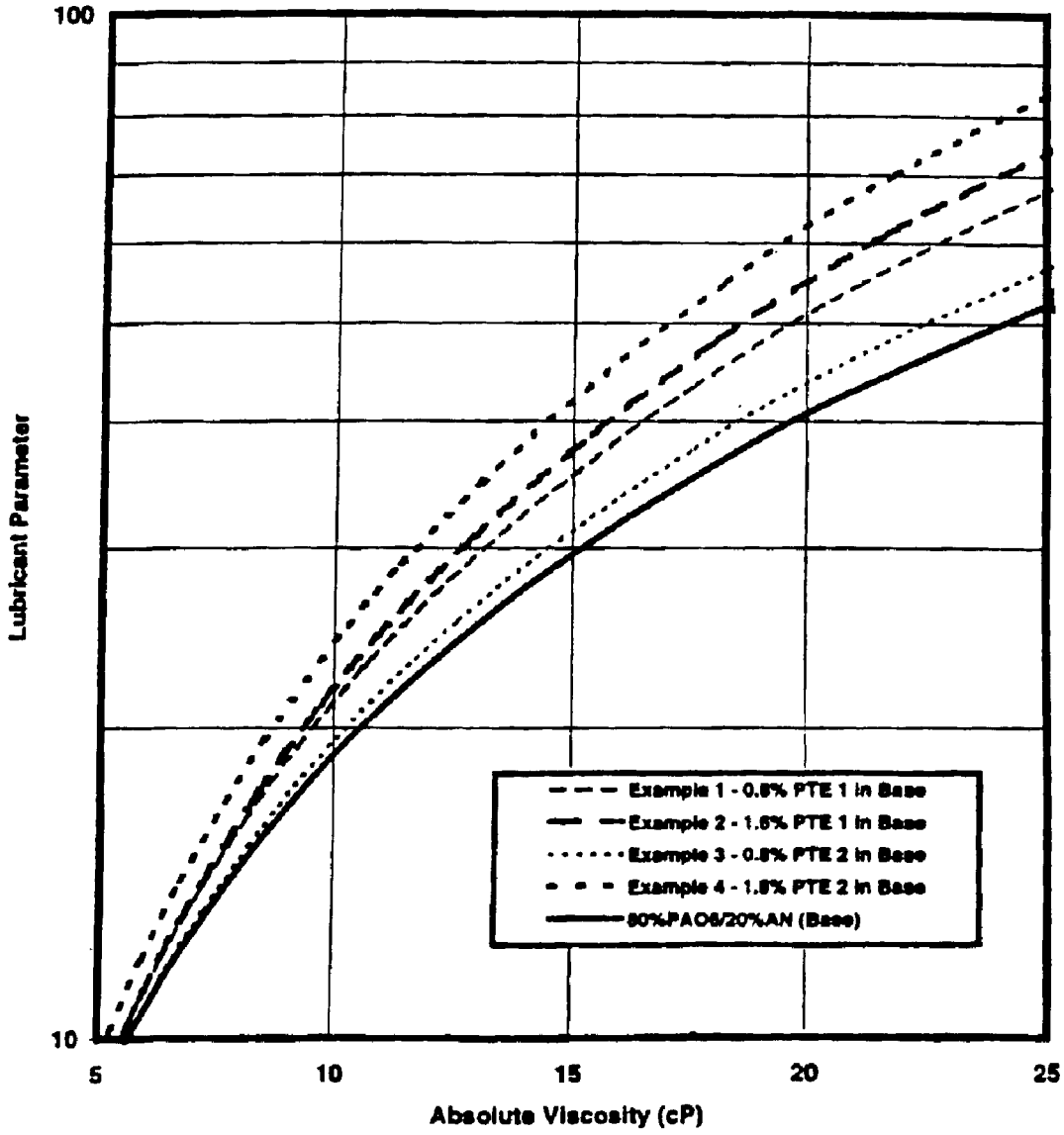
FIG. 2 displays comparative data for compositions of the present invention showing enhanced film thickness, expressed as LP, as a function of viscosity.

Since the lubricants of the present invention show only a slight increase in viscosity relative to carrier fluid alone, essentially no detectable difference in EHL film thickness (or LP) would be expected between the two. For example, the dynamic viscosity and pressure-viscosity coefficient for lubricants of the present invention are approximately the same as for carrier fluid alone because the high viscosity fluid makes up such a small component of the lubricant. Thus, film thickness (LP) is predicted to be similar for both carrier fluid and present lubricant. However, FIGS. 1 and 2 display the superior film thickness, expressed as LP, of the presently described lubricants as a function of temperature and dynamic viscosity in comparison with carrier fluid alone. As film thickness typically follows LP as a function of about the 0.7 power, film thickness enhancement by the relatively small amounts of added high viscosity fluid can be up to 50% greater relative to the carrier fluid alone at any given viscosity. In order to achieve this result with standard liquid lubricants known in the art, approximately a 75% higher viscosity fluid at operating temperatures would be required.

In addition, the lubricants of the present invention show reduced EHL shear strength (measured as traction coefficients) relative to carrier fluid alone as measured in a Line Contact Traction Rig described in U.S. Pat. No. 5,372,033, incorporated herein by reference. Typically, high viscosity fluids suitable for the present invention may have lower EHL shear strengths as compared with carrier fluid alone, and shear strength behavior can be considered, to a first approximation, as a linear additive function of the shear strength properties of the components. For instance, the shear strength (SS) of a composition having components A (50% by weight), B (30% by weight), and C (20% by weight), with respective shear strengths a, b, and c, would be the weighted average of component shear strengths as expressed in equation 2 for this particular example:

$$SS=(0.5)a+(0.3)b+(0.2)c \quad \text{(Eq. 2)}$$

Figure 3:
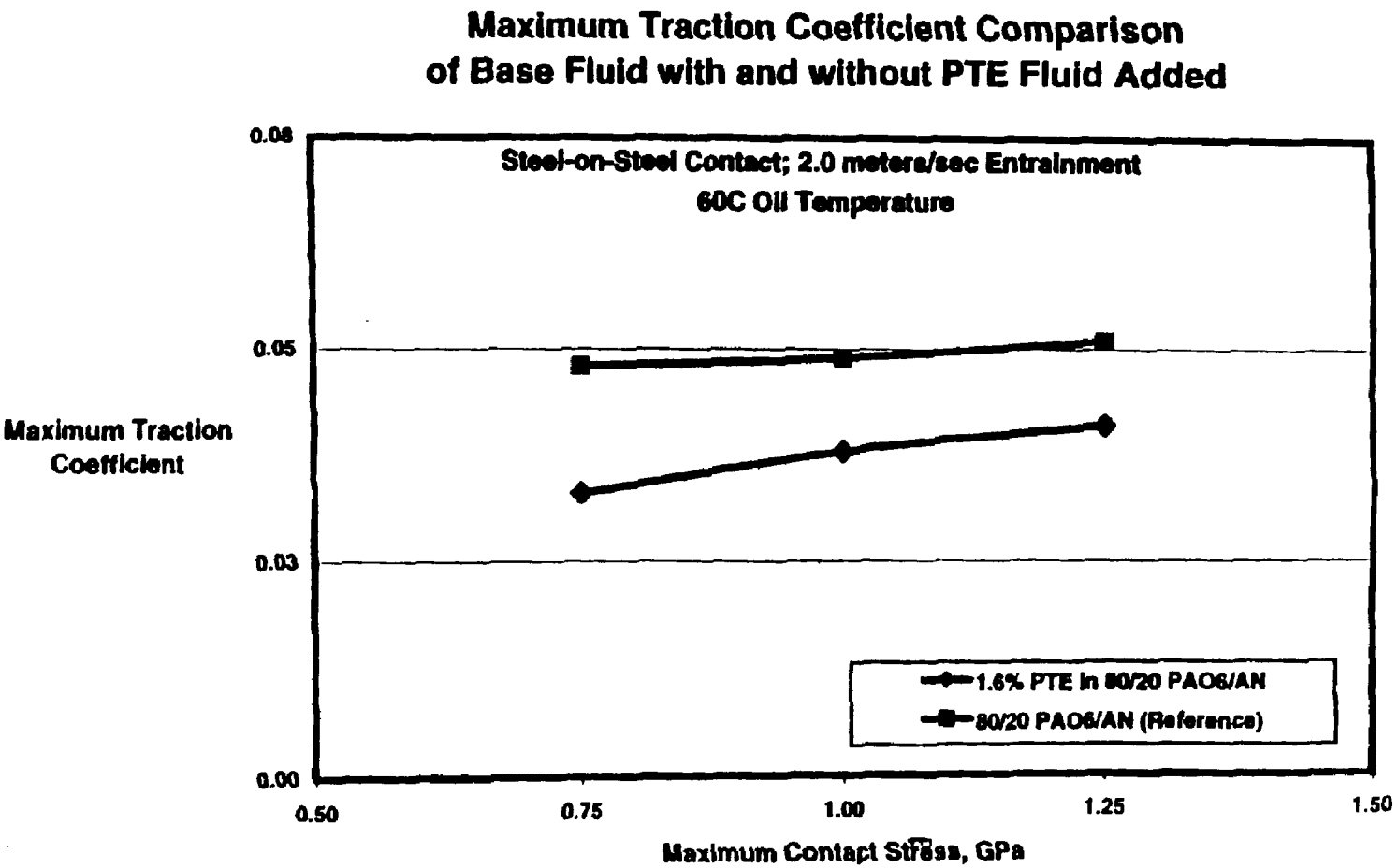
FIG. 3 displays reduced shear strength for compositions of the present invention with respect to shear strength of the carrier alone.

Therefore, the relatively small amounts of high viscosity fluid in the lubricants of the present invention are expected to contribute negligibly to shear strength properties. However, as shown in FIG. 3, approximately a 30% reduction in the maximum traction coefficients (shear strength) is unexpectedly observed. Therefore, lubricant compositions of the present invention preferably have lower (or reduced) shear strengths as compared with the calculated shear strength based on the weighted average of the components of the lubricant composition. In preferred embodiments, the lubricants described herein have shear strengths reduced by at least about 5%, or more preferably by at least about 15%, or even more preferably by at least about 30% as compared with the calculated shear strength for the individual components.

Also contemplated by the present invention are methods of lubrication. Specifically, encompassed is a method of lubrication comprising the steps of providing a lubricant described herein and applying the lubricant to a mechanical assembly having movable contacting surfaces. The mechanical assembly may be any machine containing surfaces that repeatedly move against each other. The mechanical assembly can have components that operate normally under hydrodynamic, elastohydrodynamic, mixed boundary and/or boundary condition or combinations of any or all of these. Preferably, the mechanical assembly operates under elastohydrodynmic lubricating conditions which involves the generation and maintenance of a lubricating film by the elastic deformation of non-conforming, contacting surfaces. Examples of mechanical assemblies that operate under elastohydrodynamic lubricating conditions include, but are not limited to, gears, rolling bearings, cams, and traction devices.

The unusual properties of the lubricants of the present invention, including greater film thickness and relatively low viscosity and shear strength, contribute to the observed superior lubricating performance. For instance, lowered shear strength and relatively low viscosities help maintain lower operating temperatures for decreased oil film breakdown and longer oil and machine component lives and improved energy efficiency. Further, reduction in shear strength contributes to reduced surface shear stress for longer machine component life involving reduced metal fatigue and higher scuffing loads. Greater film thickness benefits all aspects of lubrication, providing better protection of surfaces from reduced friction and operational wear and reducing the need for other lubricating additives to compensate for insufficient surface protection.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

EXAMPLES

Example 1

Lubricants of the Present Invention

Presented in Table 1 are four lubricant compositions (indicated by weight percent) and their corresponding carrier composition. Selected properties are included at the bottom of the table. Both PTE fluids were derived from p-THF and i-C9 mono-acid/oleic dimer diacid and differ by kinematic viscosity (specified below). As is evidenced in this Table 1, the viscosities of the carrier fluid and the lubricants of the present invention are comparable.

TABLE 1

Lubricant compositions and their properties

| | Carrier | No. 1 | No. 2 | No. 3 | No. 4 |
|---|---|---|---|---|---|
| PAO6 (wt %) | 80.00 | 82.50 | 81.70 | 82.50 | 81.70 |
| C16-alkyl naphthalene (wt %) | 20.00 | 16.70 | 16.70 | 16.70 | 16.70 |
| PTE1 (wt %, kv @ 40° C. = 2250 cP) | — | 0.80 | 1.60 | — | — |
| PTE2 (wt %, kv @ 40° C. = 9000 cP) | — | — | — | 0.80 | 1.60 |
| Kinematic viscosity (cp @ 40° C.) | 30.22 | 31.23 | 31.81 | 30.85 | 31.99 |
| Kinematic viscosity (cp @ 100° C.) | 5.62 | 5.80 | 5.98 | 5.85 | 6.09 |
| Viscosity Index | 126.9 | 130.4 | 140.4 | 135.8 | 140.7 |
| Density @ 75° F. (g/cm$^3$) | 0.836 | 0.837 | 0.838 | 0.837 | 0.837 |

Example 2

Process Description for Preparation of poly-THF Complex Ester Fluids

TABLE 2

| Raw materials | | | |
|---|---|---|---|
| Material | Lbs. | Lb. Moles | Equivalents |
| Poly THF 250 | 404 | 1.82 | 3.64 |
| Adipic acid | 212 | 1.45 | 2.90 |
| Iso-pentanoic acid | 84 | 0.82 | 0.82 |
| Dibutyl tin oxide | 0.10 | Catalyst | X |
| Xylene | 25 | Solvent | X |

1 To a clean, dry 100 gallon reactor, load the poly THF 250.
2 Agitator on, load adipic acid and dibutyl tin oxide.
3 Pull 50 mmHg vacuum, and re-pressurize to atmospheric pressure with nitrogen.
4 Load 25 lbs. of xylene for reflux solvent.
5 Heat to 240° C., removing about 52 lbs. water via reflux. Continue until TAN <0.5.
6 When TAN <0.5, cool to 150° C.
7 Load iso-pentanoic acid, and heat to 240° C. Continue reflux at 240° C. until hydroxyl number is <1.
8 When hydroxyl number <1, pull 15–20 mmHg vacuum and strip off excess iso-pentanoic acid. Continue stripping until TAN < 0.8. Strip should be about 8–10 lbs. iso-pentanoic acid and 25 lbs. xylene.
9 Cool to about 70° C., and add 5 lbs. of 25% aqueous sodium hydroxide solution, 1.6 lbs. activated carbon, and 2.5 lbs. water. Mix 1 hour.
10 Pull 20 mmHg vacuum and heat to 90° C. to remove water. Hold 1 hour.
11 Break vacuum with nitrogen, and hold at 90–95° C. for filtration.
12 Filter product into drums through Sparkler filter with ~2 micron filter aid coating.

What is claimed is:

1. The lubricant composition comprising:

(a) carrier fluid comprising about 10% to about 90% by weight polyalphaolefins and about 10% to about 90% by weight alkylated aromatics; and (b) higher viscosity fluid, wherein said carrier fluid and said high viscosity fluid are substantially immiscible and together form a stable emulsion having a dynamic viscosity and shear strength, said stable emulsion capable of producing a lubricating film thickness greater than the expected film thickness.

2. The lubricant composition of claim 1 wherein said lubricating film thickness is at least about 5% greater than said expected film thickness.

3. The lubricant composition of claim 1 wherein said lubricating film thickness is at least about 25% greater than said expected film thickness.

4. The lubricant composition of claim 1 wherein said lubricating film thickness is at least about 50% greater than said expected film thickness.

5. The lubricant composition of claim 1 wherein said dynamic viscosity of said emulsion is not more than about 10% greater than the dynamic viscosity of said carrier fluid.

6. The lubricant composition of claim 1 wherein said dynamic viscosity of said emulsion is not more than about 5% greater than the dynamic viscosity of said carrier fluid.

7. The lubricant composition of claim 1 wherein said dynamic viscosity of said emulsion is not more than about 1% greater than the dynamic viscosity of said carrier fluid.

8. The lubricant composition of claim 1 having a lower shear strength than the calculated shear strength based on the weighted average of the components of said lubricant composition.

9. The lubricant composition of claim 8 wherein said shear strength of said emulsion is lower by at least about 5% of said calculated shear strength.

10. The lubricant composition of claim 8 wherein said shear strength of said emulsion is lower by at least about 15% of said calculated shear strength.

11. The lubricant composition of claim 8 wherein said shear strength of said emulsion is lower by at least about 30% of said calculated shear strength.

12. The lubricant composition of claim 1 wherein said lubricant composition comprises from about 0.01% to about 10% by weight higher viscosity fluid.

13. The lubricant composition of claim 1 wherein said lubricant composition comprises from about 0.01% to about 10% by weight higher viscosity fluid.

14. The lubricant composition of claim 1 wherein said carrier fluid comprises about 50% to about 90% by weight PAOs and about 10% to about 50% by weight alkylated aromatics.

15. The lubricant composition of claim 1 wherein said carrier fluid comprises about 75% to about 85% by weight PAOs and about 15% to about 25% by weight alkylated aromatics.

16. The lubricant composition of claim 1 wherein said higher viscosity fluid comprises polyethers, polyalkylene glycols, or derivatives thereof, or related fluids containing polar functionality.

17. A lubricant composition comprising:

(a) carrier; and (b) higher viscosity poly-THF ester fluid, wherein said carrier fluid and said high viscosity fluid are substantially immiscible and together form a stable emulsion having a dynamic viscosity and shear strength, said stable emulsion capable of producing a lubricating film thickness greater than the expected film thickness.

18. The lubricant composition of claim 17 comprising said poly-THF ester fluid in an amount of from about 0.01% to about 10% by weight.

19. The lubricant composition of claim 17 comprising said poly-THF ester fluid in an amount of from about 0.01% to about 3% by weight.

20. The lubricant composition of claim 17 comprising said poly-THF ester fluid in an amount of from about 0.01% to about 1.6% by weight.

21. The lubricant composition of claim 1 further comprising at least one component selected from the group consisting of emulsifiers, rust and corrosion inhibitors, friction modifiers, metal passivators, dispersants, detergents, antioxidants, defoamants, thermal stabilizers, and extreme pressure/antiwear agents.

22. A lubricant composition comprising an emulsion of:

(a) a carrier fluid; and (b) a higher viscosity fluid wherein (a) the carrier fluid comprises a blend of PAO6 and alkylated naphthalenes; and (b) the higher viscosity fluid is a poly-THF ester fluid present in said lubricant in an amount of from about 0.01% to about 10% by weight.

23. The lubricant composition of claim 22 wherein said carrier fluid comprises about 75% to about 85% by weight PAO6 and about 15% to about 25% by weight alkylated naphthalenes.

24. The lubricant composition of claim 22 wherein said carrier fluid comprises about 80% by weight PAO6 and about 20% by weight alkylated naphthalenes.

25. In the method of lubrication by applying a lubricant composition to a mechanical assembly having movable contacting surfaces, the improvement comprising applying a lubricant composition comprising an emulsion of (a) a carrier fluid comprising about 10% to about 90% by weight polyalphaolefins and about 10% to about 90% by weight alkylated aromatics; and (b) a minor amount of a higher viscosity fluid wherein the composition forms a lubricating fluid thickness greater than the expected film thickness.

26. The improvement of claim 25 wherein said lubricating film thickness is at least about 5% greater than said expected film thickness.

27. The improvement of claim 25 wherein said lubricating film thickness is at least about 25% greater than said expected film thickness.

28. The improvement of claim 25 wherein said lubricating film thickness is at least about 50% greater than said expected film thickness.

29. The improvement of claim 25 wherein said emulsion has a dynamic viscosity not more than about 10% greater than the dynamic viscosity of said carrier fluid.

30. The improvement of claim 25 wherein said emulsion has a dynamic viscosity not more than about 5% greater than the dynamic viscosity of said carrier fluid.

31. The improvement of claim 25 wherein said emulsion has a dynamic viscosity not more than about 1% greater than the dynamic viscosity of said carrier fluid.

32. The improvement of claim 25 wherein said lubricant composition has a shear strength lower than the calculated shear strength based on the weighted average of the components of said lubricant composition.

33. The method of claim 32 wherein said shear strength of said emulsion is lower by at least about 5% of said calculated shear strength.

34. The method of claim 32 wherein said shear strength of said emulsion is lower by at least about 15% of said calculated shear strength.

35. The method of claim 34 wherein said shear strength of said emulsion is lower by at least about 30% of said calculated shear strength.

36. The method of claim 25 wherein said lubricant composition comprises from about 0.01% to about 10% by weight high viscosity fluid.

37. The method of claim 25 wherein said lubricant composition comprises from about 0.01% to about 3% by weight high viscosity fluid.

38. The method of claim 25 wherein said carrier fluid comprises about 50% to about 90% by weight PAOs and about 10% to about 50% by weight alkylated aromatics.

39. The method of claim 25 wherein said carrier fluid comprises about 75% to about 85% by weight PAOs and about 15% to about 25% by weight alkylated aromatics.

40. The method of claim 25 wherein said high viscosity fluid comprises polyethers, polyalkylene glycols, or derivatives thereof, or related fluids containing polar functionality.

41. The method of claim 25 wherein said high viscosity fluid comprises poly-THF ester fluid.

42. The method of claim 41 wherein said poly-THF ester fluid is present in an amount of from about 0.01% to about 10% by weight.

43. The method of claim 41 wherein said poly-THF ester fluid is present in an amount of from about 0.01% to about 3% by weight.

44. The method of claim 41 wherein said poly-THF ester fluid is present in an amount of from about 0.01% to about 1.6% by weight.

45. A method of lubrication comprising the steps of:

(a) providing a lubricant composition comprising:

(i) carrier fluid comprising a blend of PAO6 and alkylated naphthalenes; and (ii) poly-THF ester fluid wherein said ester fluid is present in the lubricant in an amount of from about 0.01% to about 10% by weight; and (b) applying said lubricant composition to a mechanical assembly having movable contacting surfaces operating under elastohydrodynamic lubricating conditions.

* * * * *